United States Patent [19]

Sugizaki et al.

[11] Patent Number: 4,650,176

[45] Date of Patent: Mar. 17, 1987

[54] AUTOMATIC SHEET REVERSING APPARATUS

[75] Inventors: Tsugio Sugizaki; Tadashi Abe; Fumio Haibara; Ritsuo Fujii; Hiroaki Ura; Tooru Matsumoto, all of Hachioji, Japan

[73] Assignee: Suzuki International Patent Office, Tokyo, Japan

[21] Appl. No.: 824,634

[22] Filed: Jan. 31, 1986

[30] Foreign Application Priority Data

Feb. 6, 1985 [JP] Japan ..... 60-19844
May 31, 1985 [JP] Japan ..... 60-118195

[51] Int. Cl.[4] ..... B65H 5/00

[52] U.S. Cl. ..... 271/225; 198/603; 271/65; 271/184; 271/902; 355/35; 414/37

[58] Field of Search ..... 271/3.1, 65, 225, 184, 271/185, 186, 902, 221, 222; 355/35 H, 145 H; 198/603, 606, 422; 414/37, 91

[56] References Cited

U.S. PATENT DOCUMENTS 4,418,805 12/1983 Garavuso ..... 271/99
4,579,325 4/1986 Pinckney et al. ..... 271/3.1

*Primary Examiner*—Douglas C. Butler
*Assistant Examiner*—John A. Carroll
*Attorney, Agent, or Firm*—Jordan B. Bierman

[57] ABSTRACT

In an automatic sheet reversing apparatus having a convey/reversing section with a plurality of conveyor belts, a stacking/moving section with a stopper for stopping a leading end of a reversed sheet, and a feed section, the stopper is located below the conveyor belts. The upper portion of the stopper is located above the lower surface of the conveyor belt.

8 Claims, 15 Drawing Figures

FIG. 8
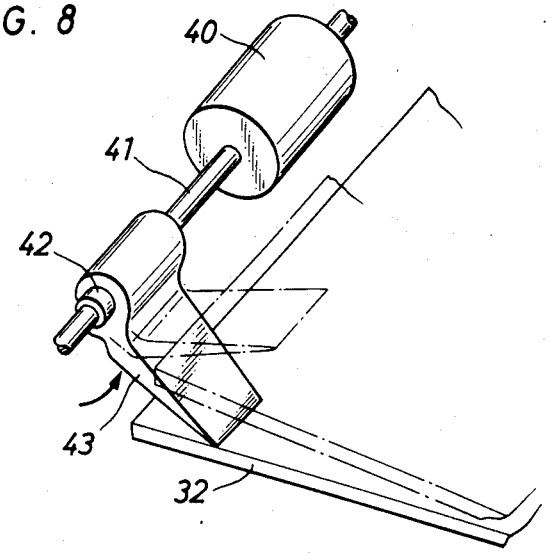
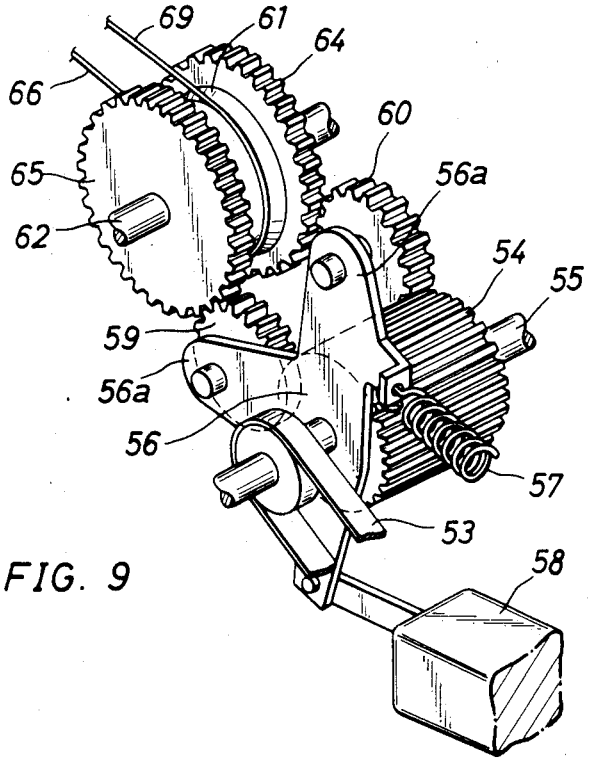
FIG. 9

AUTOMATIC SHEET REVERSING APPARATUS

BACKGROUND OF THE INVENTION

1. Field of the Invention

The present invention relates to an automatic sheet reversing apparatus and, more particularly, to an automatic sheet reversing apparatus which is used for an electrophotographic copying apparatus or a printing apparatus and which reverses a one-side copied sheet and feeds the reversed sheet in the electrophotographic copying apparatus or the printing apparatus so as to obtain a two-side copied sheet.

2. Description of the Prior Art

In conventional automatic sheet reversing apparatuses which are used in electrophotographic copying apparatuses and printing apparatuses and which reverse one-side copied sheets and feed the reversed sheets to obtain two-side copied sheets, a predetermined number of one-side copied sheets are received, and the sheets are then fed such that the trailing ends thereof are fed first in the second copying process. The sheets are conveyed in a paper feeder and then fed to the electrophotographic copying apparatus or the printing apparatus. Conventional automatic paper reversing apparatuses of this type are described in Japanese Patent Disclosure Nos. 59-82247 and 59-114227. In these apparatuses, when one-side copied sheets are reversed and held in a stacker, the stacker is inclined forward, so that the feed direction of the sheets is downward and the leading ends of the sheets abut against the stopper of the stacker, thus sequentially stacking the sheets.

When the sheets are stacked in the manner as described above, however, the sheets are electrostatically charged to interfere smooth feeding. Furthermore, the sheets are conveyed such that an air layer of a predetermined thickness is formed between every two adjacent sheets and disables smooth stacking. When the sheets are charged as described above, the sheets are attracted to adjacent members. In this case, paper jam occurs and smooth feeding cannot be performed.

In the conventional sheet reversing apparatus of this type, if the reversed one-side copied sheets are curled upward when they are stacked in a stacker as an intermediate tray, the two sides of the sheet are curved upward. As a result, the sheets cannot be properly housed in the intermediate tray.

In this case, when a press member is used to press the curled sheet, the member must be placed on side plates for defining the two sides of the sheets or is disposed inside the side plates.

Since the side plates are moved in accordance with paper sizes, however, the conventional press plate must be arranged in accordance with a minimum or maximum paper size and be placed on the side plates upon its inward movement.

For this reason, when the press plate has a minimum paper size, it cannot properly press a maximum size sheet. Similarly, when the press plate has a maximum paper size, it cannot properly press a minimum size sheet, either.

SUMMARY OF THE INVENTION

It is a first object of the present invention to provide an automatic paper reversing apparatus which can eliminate the conventional drawbacks described above, which can guide sheets to a proper stacking position, and thereafter which can sequentially feed the stacked sheets.

It is a second object of the present invention to provide an automatic sheet reversing apparatus which has an intermediate tray which has a sufficient sheet press effect throughout the surface of the sheet of any size to prevent incomplete feeding due to curls and which does not interfere movement of side plates.

In order to achieve the first object of the present invention, there is provided an assembly comprising: a convey/reversing section for receiving a one-side copied sheet and conveying the sheet forward through a conveyor belt, and thereafter reversing the sheet and conveying it backward; a stacking/moving section, having a stopper brought into contact with a distal end of the reversed sheet, for storing the sheets sequentially reversed and conveyed and for moving the sheets forward to a predetermined position by the stopper; and a feed section having a push-up plate located at a front central position of a lower surface of the sheet stopped at the predetermined position to push up the front end of the sheet and a feed belt brought into contact with the upper surfaces of the pushed-up sheets to sequentially feed the sheets.

In order to achieve the second object of the present invention, there is provided an intermediate tray comprising: a stacking section, having a stopper brought into contact with the distal end of the one-side copied sheet and side plates movable in accordance with a paper size to guide two sides of the sheet; and a feed section for sequentially feeding the stacked sheets, wherein a plurality of press members are arranged at the inlet port of the stacking section, divided in accordance with a paper size, and brought into contact with the upper surface of the sheet.

The above and other objects, features and advantages of the present invention will be readily understood from the following detailed description with reference to the accompanying drawings.

BRIEF DESCRIPTION OF THE DRAWINGS

FIG. 8 is a perspective view of a pivot mechanism for a double feed prevention roller 9;

FIG. 9 is a perspective view showing the main part of a drive switching mechanism for the stopper and the side plates.

DETAILED DESCRIPTION OF THE PREFERRED EMBODIMENT

A preferred embodiment according to the present invention will be described in detail with reference to the accompanying drawings.

Figure 1:
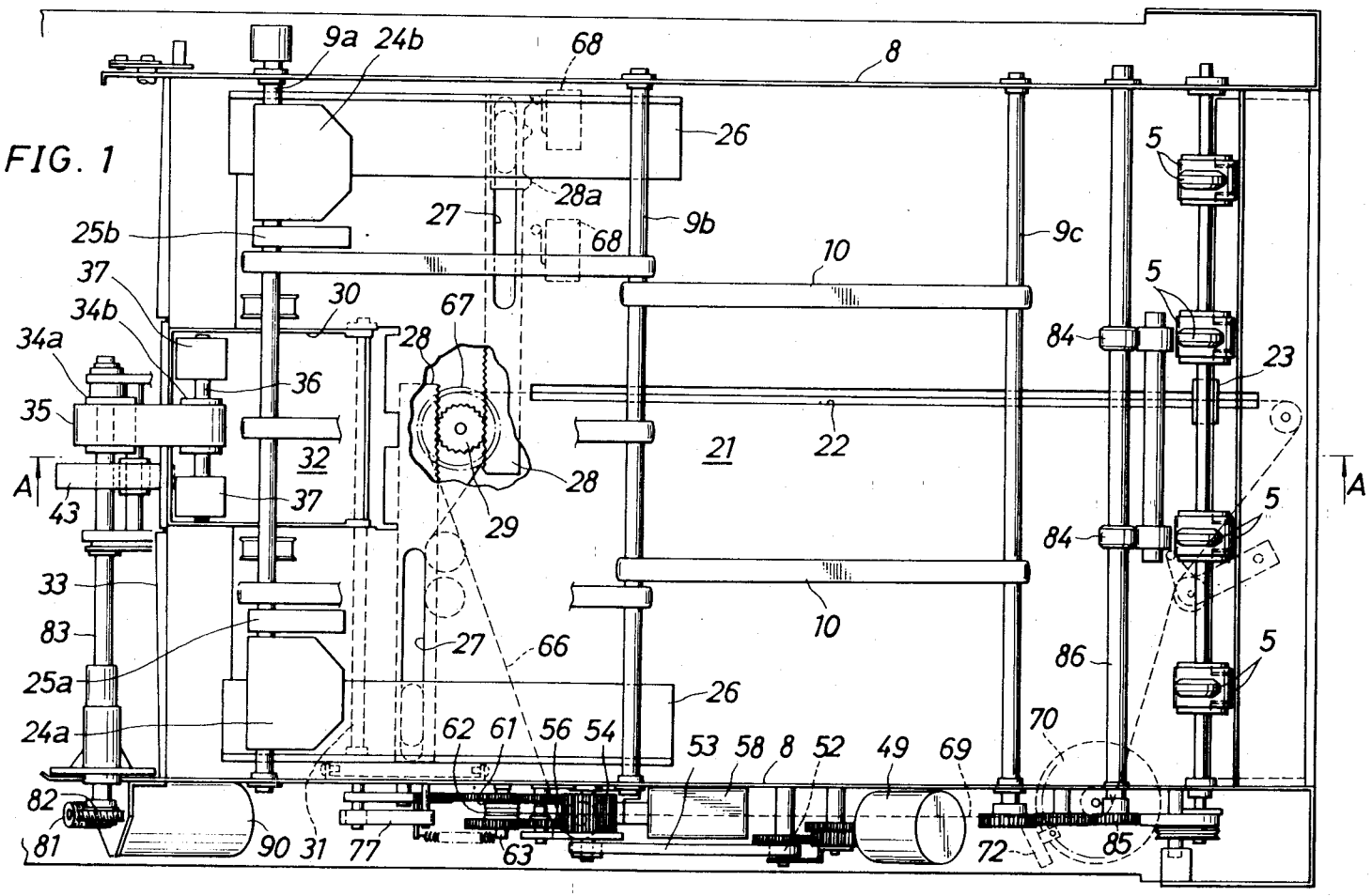
FIG. 1 is a plan view showing the overall construction of an automatic sheet reversing apparatus according to an embodiment of the present invention.
Figure 2:
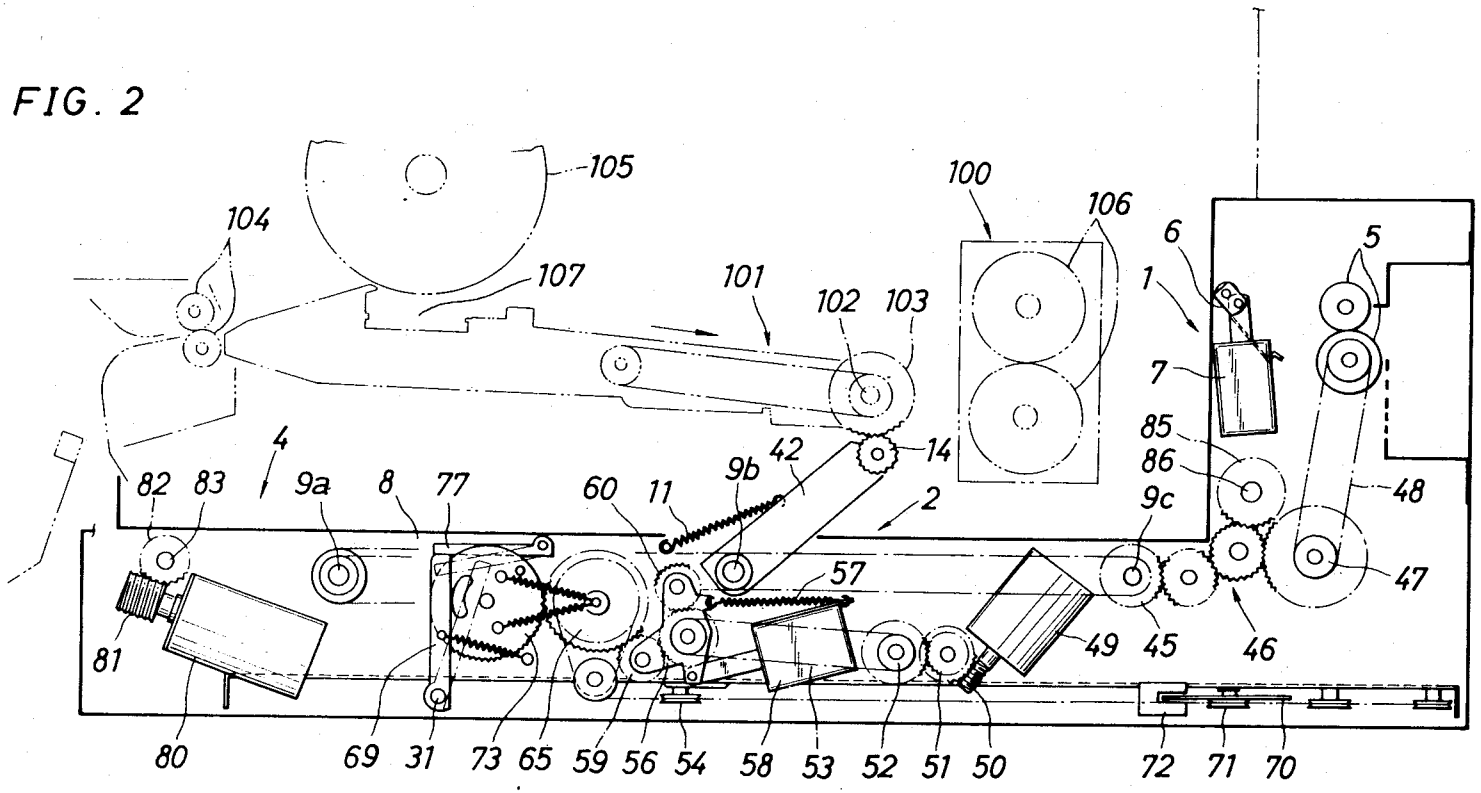
FIG. 2 is a side view of the automatic sheet reversing apparatus shown in FIG. 1.
Figure 3:
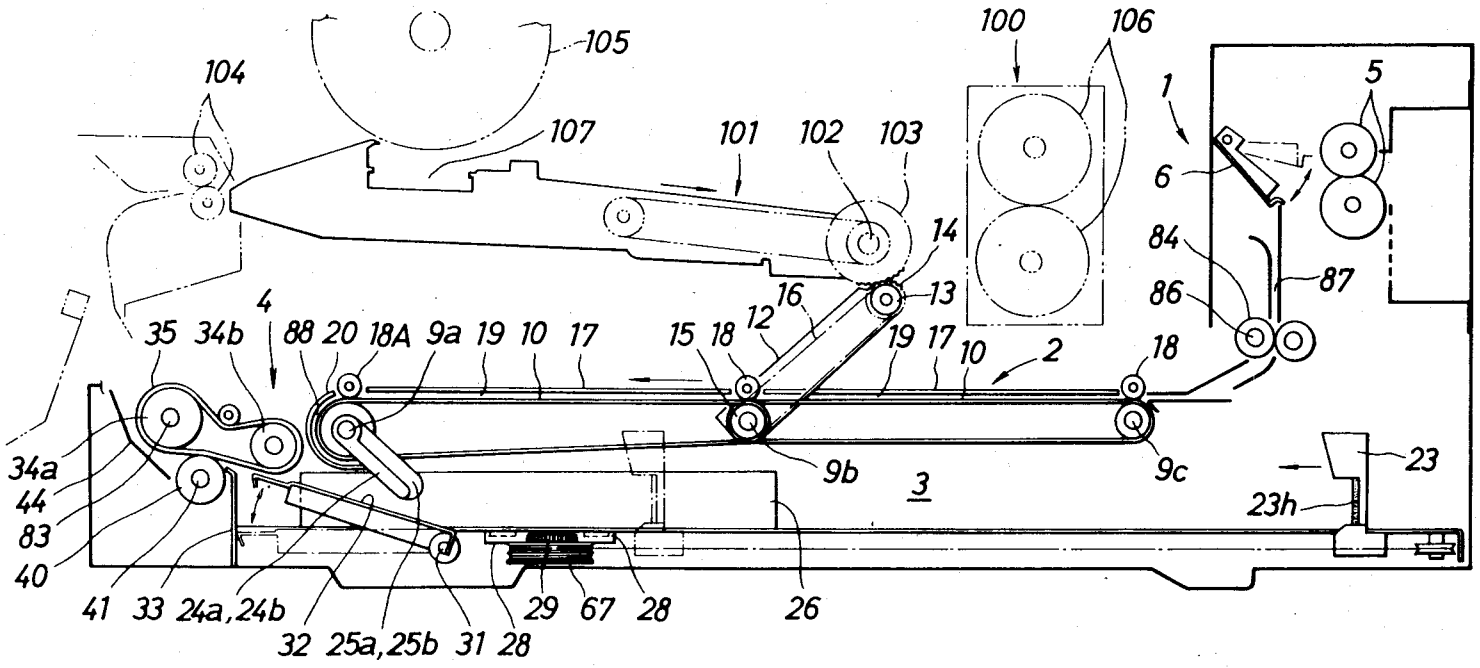
FIG. 3 is a longitudinal sectional view of the automatic sheet reversing apparatus of FIG. 1 taken along the line A—A.

FIGS. 1, 2 and 3 show an automatic sheet reversing apparatus according to an embodiment of the present invention. The automatic sheet reversing apparatus is arranged at the lower portion of an electrophotographic copying apparatus.

As schematically illustrated in FIG. 3, the automatic sheet reversing apparatus comprises an exhaust switching section 1, a convey/reversing section 2, a stacking-/moving section 3, and a feed section 4.

A flapper 6 is arranged at the exhaust switching section 1 and can be switched between an exhaust position where a one-side copied sheet from a fixing unit 100 of the electrophotographic copying apparatus is directed to be exhausted outside the copying apparatus through an exhaust roller 5 and a position where the sheet is directed toward the convey/reversing section 2. The flapper 6 is operated by a solenoid 7.

A plurality of conveyor belts 10 are arranged in the convey/reversing section 2 and are looped between three shafts 9*a*, 9*b* and 9*c* mounted on side plates 8 of the chassis. A swing plate 12 is mounted at an end of the central one (9*b*) of the shafts 9*a*, 9*b* and 9*c*. The swing plate 12 is vertically swingable with respect to the shaft 9*b* and is biased upward by a spring 11 hooked between itself and one side plate 8. A gear 14 with a pulley 13 is rotatably mounted on the distal end of the swing plate 12. A rotational force transmission belt 16 is looped between the pulley 13 and a pulley 15 fixed to the end of the shaft 9*b*. The gear 14 with the pulley 13 meshes with a gear 103 mounted on a shaft 102 for a conveyor belt 101 in the electrophotographic copying apparatus so as to transmit the rotational force to drive the conveyor belts 10 looped between the shafts 9*a*, 9*b* and 9*c*.

Cover plate 17 is arranged in the convey/reversing section 2 to cover the plurality of conveyor belts 10 looped between the three shafts 9*a*, 9*b* and 9*c*. Rotatable rollers 18 are in rolling contact with upper surface portions of belts 10 looped around the shafts 9*a*, 9*b* and 9*c* to support the cover plate 17 and constitute a sheet convey path 19 between the conveyor belt 10 and the cover plate 17.

Since a roller 18A mounted in the cover plate 17 is located on the upper surface portion of the conveyor belt 10 looped around the shaft 9*a* located in the front convey direction, the sheet is urged against the conveyor belt 10 immediately before the sheet is reversed between a reversing guide plate 20 and the conveyor belt 10. The sheet can be smoothly inserted in the reversing guide plate 20.

The stacking/moving section 3 is arranged such that a stopper as a moving member is mounted in the intermediate tray. An elongate hole 22 extending along the back-and-forth direction is formed in the central portion of a bottom plate 21 of the chassis. The lower portion of a stopper 23 is located inside the hole 22, and the upper portion thereof has a front surface gradually extending forward from the lower end to the upper end. The upper portion of the stopper 23 is located above the lower surface of the conveyor belt 10 of the convey/-reversing section 2. The stopper 23 can be movable in the hole 22 along the back-and-forth direction.

Figure 4A:
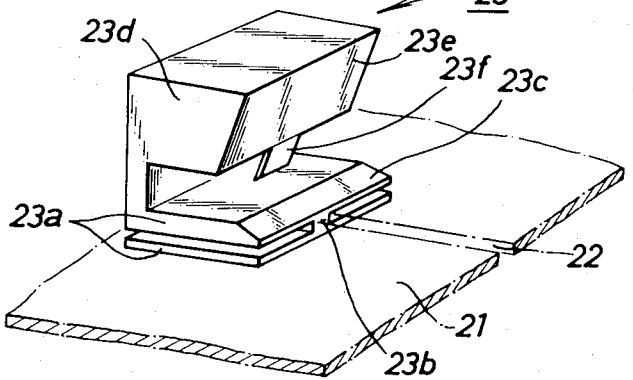
FIG. 4A is a perspective view of a stopper in the apparatus in FIG. 1.

The detailed arrangement of the stopper 23 is illustrated in FIG. 4A. A bottom portion 23*a* of the stopper 23 clamps the bottom plate 21 through a connecting portion 23*b* of the stopper 23. The stopper 23 can be moved along the direction of the hole 22. The front end of the bottom portion 23 which is located above the bottom plate 21 is inclined to constitute an inclined portion 23*c*.

The rear end of the bottom portion 23*a* vertically stands and its upper portion extends forward. The front portion of an extending portion 23*d* constitutes a surface 23*e* which is inclined backward. A flexible tongue 23*f* is continuously formed at the central portion of the lower end of the inclined surface 23*e*.

Figure 5A:
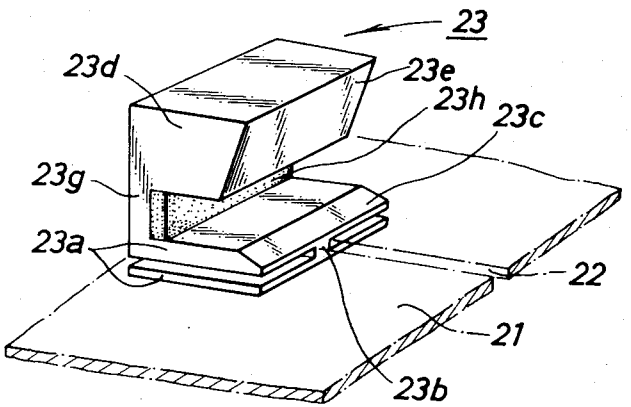
FIG. 5A is a perspective view of another stopper in the apparatus in FIG. 1.
Figure 5B:
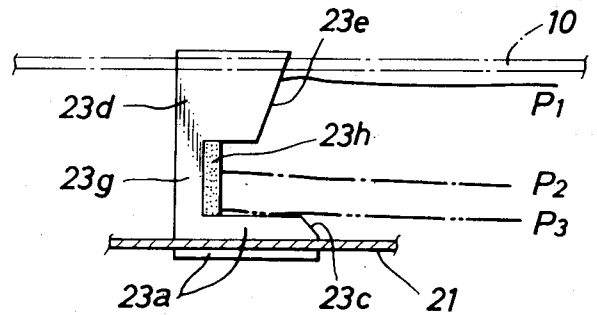
FIG. 5B is a side view for explaining a function of the stopper in FIG. 5A.

FIG. 5A shows another stopper which is similar to that shown in FIG. 4A. The same reference numerals in FIG. 5A denote the same parts in FIG. 4A, and a detailed description thereof will be omitted. The only difference between the stoppers in FIGS. 4A and 5A is that a foamed urethane friction member 23*h* is adhered to a front surface of a leading portion of an upright portion 23*g* in FIG. 5A in place of the tongue 23*f* in FIG. 4A.

In the above stopper, the friction member 23*h* is made of foamed urethane. However, the member 23*h* need only prevent slippage of the trailing end of the sheet, and can be a member with a plurality of horizontal grooves.

As is apparent from FIG. 1, one end of each of curl press members 24*a*, 24*b*, 25*a* and 25*b* is fixed to the shaft 9*a*. The curl press members 24*a* and 24*b* constitute one pair; and the curl press members 25*a* and 25*b* constitute the other pair. The curl press members 24*a* and 24*b* are located at outermost positions falling within the width of the maximum paper size. The curl press members 25*a* and 25*b* are located at outermost positions falling within the width of the minimum paper size.

If a maximum paper size is A3 and a minimum paper size is B5, the press members 24*a* and 24*b* are located within the width of an A3 size sheet but outside the width of a B5 size sheet. The press members 25*a* and 25*b* are located within the width of a B5 size sheet.

The outer press members 24*a* and 24*b* have trapezoidal front ends. Although the rear ends of the press members 24*a*, 24*b*, 25*a* and 25*b* are pivotally mounted on the shaft 9*a* and these members are set in a free state, the members do not suspend from the shaft 9*a* but extend in the sheet path and are held by the conveyor belts 10.

The arrangement of the press members is not limited to the paired arrangement described above.

Referring back to FIG. 1, left and right side plates 26 are coupled to the bottom plate 21. The lower surfaces of the side plates 26 are fixed through holes 27 to racks 28 extending in the left and right directions, respectively. The racks 28 mesh with a pinion 29 which is mounted on the lower surface of the bottom plate 21 and which is located between the racks 28. When the pinion 29. is rotated, the side plates 26 are moved close to each other or away from each other.

In the feed section 4, a push-up plate 32 is located within a rectangular recess formed at the front central portion of the stacking/moving section 3. The rear end portion of the push-up rod 32 is fixed to a shaft 31, so that the push-up plate 32 is vertically movable. A front end stopper 33 is arranged adjacent to the front end of the push-up rod 32. A feed belt 35 is looped between a pair of rollers 34*a* and 34*b* and located above the push-up rod 32. Rollers 37 are mounted on two ends of a shaft 36 of the roller 34*b* located at the push-up roller 32 side.

Figure 6:
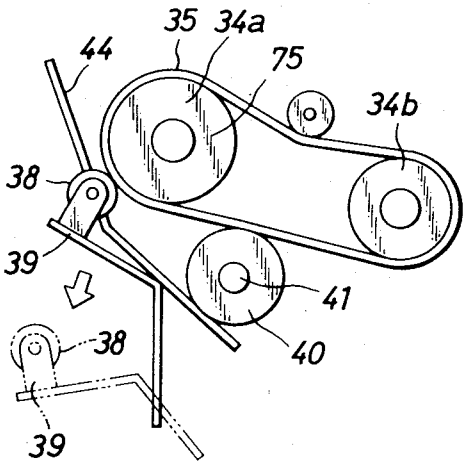
FIG. 6 is a schematic diagram showing a paper feed section for feeding a one-side copied sheet.

As shown in FIG. 6, an arm 39 with a roller 38 at its distal end is arranged at a position opposite to the roller 34*a* with respect to the feed belt 35. The arm 39 is interlocked with a double feed prevention roller 40 (to be described later). When the double feed prevention roller 40 is moved away from the feed belt 35 so as to remove a jammed sheet, the arm 39 is moved away from the feed belt 35 together with the roller 38, thus obtaining a state indicated by a dashed line.

A detailed arrangement of the front end stopper 33 is shown in FIGS. 7A to 7D. Upper bent portions 33*b* of two end portions 33*a* are gradually raised toward the central portion, and the angle of the bent portions is gradually increased toward the central portion. A central portion 33*d* coupled to the end portions 33*a* through notches 33*c* is higher than the end portions 33*b*. The upper end of the central portion 33*d* is bent in the same direction as that of the end portions 33*b*.

The double feed prevention roller 40 is brought into tight contact from the lower side with a portion of the feed belt 35 which is located in front of the front end stopper 33. A pivot member 43 is mounted on a shaft 41 of the double feed prevention roller 40 through a one-way clutch 42, as shown in FIG. 8. The pivot member 43 is always biased by a biasing member (not shown) upward, i.e., in a direction to urge the push-up rod 32 upward.

A guide plate 44 is arranged in front of the feed belt 35 to direct the sheet upward.

The drive system for the respective components will be described hereinafter. The flapper 6 in the exhaust switching section 1 is switched by the solenoid 7, as described previously. The conveyor belts 10 looped around the shafts 9*a*, 9*b* and 9*c* in the convey/reversing section 2 are driven as follows. The rotational force of the conveyor belt 101 in the electrophotographic copying apparatus is transmitted to the central shaft 9*b* through the gear 14 meshed with the gear 103, the pulley 13 rotated together with the gear 14, the belt 16 and the pulley 15 rotated together with movement of the belt 16. The transmission force is transmitted to the front and rear shafts 9*a* and 9*c* through the respective conveyor belts 10. At the same time, the gear 45 mounted on the rear shaft 9*c* rotates the exhaust roller 5 in the exhaust switching section 1 through gears 46 and then a pulley 47 and a belt 48. A feed roller 84 is mounted on a shaft of one (86) of the gears 85.

The stopper 23 in the stacking/moving section 3 and the side plates 26 are driven as follows. When a drive source 49 rotates, a gear 54 is rotated through a worm gear 50 and another gear 51 and then through a pulley 52 and a belt 53.

The main part for driving force transmission is illustrated in detail in FIG. 9. A substantially Y-shaped swing plate 56 is mounted on a shaft 55 of the gear 54. The Y-shaped swing plate 56 is swingable and biased by a spring 57 clockwise in FIGS. 2 and 9. The Y-shaped swing plate 56 is pivoted by a solenoid 58 counterclockwise against the biasing force of the spring 57. Gears 59 and 60 meshing with the gears 54 are mounted on branched portions 56a of the swing plate 56. Pulleys 61 and 62 are fixed to the side surfaces of the gears 59 and 60 and can be meshed with gears 64 and 65 rotatably mounted on a shaft 63 extending through the side plate 8.

When the solenoid 58 is held inoperative as shown in FIGS. 2 and 9, the gear 65 is rotated upon driving of the drive source 49. At the same time, the pulley 62 is rotated to rotate the pulley 67 coaxial with the pinion 29 mounted on the bottom plate 21 through a wire 66, thereby rotating the pinion 29. The side plates 26 fixed to the racks 28 meshed with the pinion 29 are moved in the holes 27 to come close to or away from each other.

A moving distance of the racks 28 is set optimally in accordance with the paper size in response to signals generated by microswitches 68 when projections 28*a* of the racks 28 are brought into contact with actuators of the microswitches 68.

When the solenoid 58 is energized, the swing plate 56 swings counterclockwise in FIGS. 2 and 9 against the biasing force of the spring 57. One gear 59 is no longer meshed with the gear 65, while the other gear 59 remains meshed with the gear 64.

The gear 64 is rotatably coaxial with the gear 65, and the pulley 61 is integrally fixed to the surface of the gear 64. The pulley 61 is coupled to the stopper 23 through a wire 69. The wire 69 is wound around a pulley 71 of a shaft portion of a disk 70 with a plurality of peripheral apertures. The disk 70 is rotated to move the stopper 23, and the drive source 49 is controlled in response to a signal from a sensor member 72 for counting the apertures of the disk 70. Therefore, the stopper 23 is separated backward from the end of the sheet by a predetermined distance in accordance with the paper length.

Figure 10:
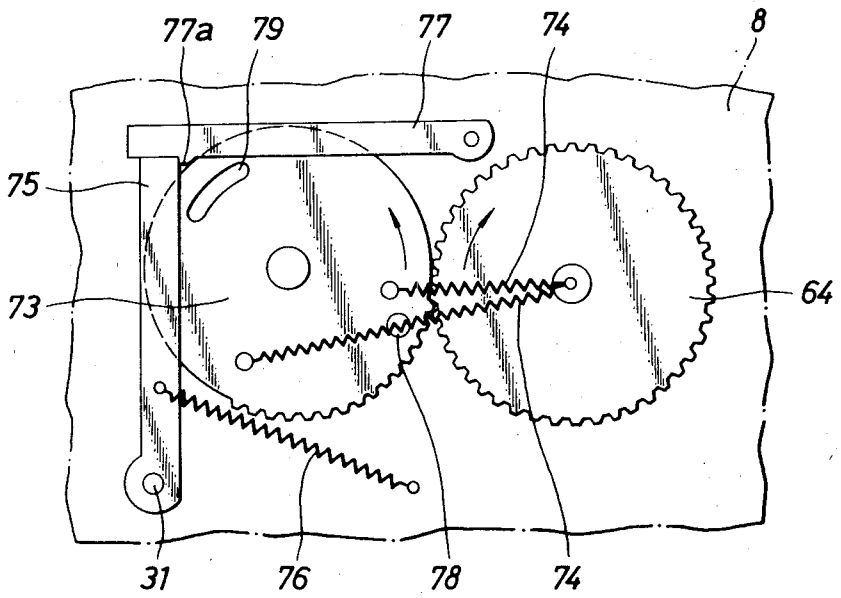
FIG. 10 is a side view of a push-up plate lifting mechanism.

As shown in FIG. 10, a tooth portion is formed on part of the circumferential surface of a gear 73 meshed with the stopper shift gear 64 rotated by the other gear 60. The tooth portion 73 is biased by two springs 74 so as to mesh with the gear 64. Therefore, only during the initial period of rotation of the gear 64, the gear 64 and the tooth portion 73*a* are rotated together.

A lever 75 is arranged at an end of the shaft 31 fixed to the push-up rod 32 in the feed section 4. The lever 75 is biased by a spring 76 clockwise and is engaged with a projection 77*a* of a lever 77 mounted on the side plate 8 to be vertically swingable. The lever 75 is thus held vertical, that is, the push-up rod 32 is held horizontal.

During the initial period of rotation of the other gear 60, the stopper 23 is moved forward through the pulley 61 and the wire 69. At the same time, the gears 64 and 73 are rotated in a direction indicated by the arrow. A pin 78 mounted on the gear 73 abuts against the lever 77 which is then moved upward. The pin 78 is disengaged from the gear 73, and the lever 75 is pivoted clockwise about the shaft 31 by the biasing force of the spring 76.

The push-up plate 32 is moved upward by the spring 76, and the front end portion of the push-up rod 32 is brought into contact with the lower surface of the feed belt 35.

When the drive source 49 is rotated in the reverse direction to set the stopper 23 in the initial wait state, the gear 73 is rotated in a direction opposite to the direction described above. During this rotation movement, an arcuated projection 79 urges the lever 75 counterclockwise, that is, the push-up plate 32 is moved downward. At the same time, since the pin 78 is disengaged from the lever 77, the lever 75 is hooked to the projection 77*a* of the lever 77, so that the lever 75 is held in a state illustrated in FIG. 10. Therefore, the push-up rod 32 is held horizontal. Even if the paper size is changed to alter the initial wait position of the stopper 23, the same operation as described above can be performed.

A drive source 80 is arranged on the side plate 8 to rotate the feed belt 35 in the feed section 4. The drive source 80 drives a shaft 83 through a worm gear 81 and a gear 82 and a roller 34a integrally mounted on the shaft 83.

Reference numeral 104 denotes aligning rollers; 105, an image carrier; 106, a fixing roller; and 107, a transfer/separation electrode.

The automatic sheet reversing apparatus according to this embodiment is shifted from the right to the left of FIGS. 2 and 3 is mounted at the lower portion of the housing of the electrophotographic copying apparatus. In this case, the swing plate 12 is held by the spring 11 in a state more upright than that shown in FIG. 2. When shifting of the automatic sheet reversing apparatus is completed, the upper end ear 14 is meshed with a gear 103 mounted on one roller of the conveyor belt 101 in the electrophotographic copying apparatus. When the conveyor belt 101 is driven, the driving force is transmitted to the shaft **9*b* through the pulley 13, the belt 16 and the pulley 15. Furthermore, the spring 11 biases the gears 103 and 14** to allow them to properly mesh with each other.

In this case, since the convey direction of the conveyor belt 101 in the electrophotographic copying apparatus located on the automatic sheet reversing apparatus is indicated by the arrow, the conveyor belts 10 in the convey/reversing section 2 are driven in the direction indicated by the arrow.

When the upper electrophotographic copying apparatus is started, the conveyor belts 10 in the convey/-reverse section 2 is moved along the direction indicated by the arrow.

Thereafter, when the two-side copy mode is set to copy images on two surfaces of a sheet, the solenoid 7 in the exhaust switching section 1 is actuated to move the flapper 6 in the position indicated by the solid line in FIG. 3, so that the sheet is guided to the automatic sheet reversing apparatus.

The side plates 26 and the stopper 23 are moved to the optimal positions in accordance with the paper size set at the operation panel in the electrophotographic copying apparatus and are held at the optimal positions. When the drive source 49 is driven while the solenoid 58 is held inoperative, one gear 59 of the Y-shaped swing plate 56 is rotated through the belt 53. The gear 65 meshed with one gear 59 and the pulley 62 are rotated, and thus the pinion 29 is rotated through a wire 66. The side plates 26 are set by the racks 28 at proper positions corresponding to the preset paper size. Shifting of the side plates 26 can be stopped at the optimal positions in response to the On and OFF signals from the microswitches 60.

When the solenoid 58 is actuated, the driving force of the drive source 49 is transmitted to the gear 64 and the pulley 61 through the belt 53, so that the stopper 23 is moved through the wire 69. A displacement of the stopper 23 is optimally controlled since the wire 69 causes the disk 70 wound with the wire 69 to rotate and the sensor member 72 counts the apertures of the disk 70. As a result, the stopper 23 is stopped in the optimal position.

In the initial wait state, an image formed on the image carrier 105 is transferred to the sheet through the transfer/separation electrode 107. The sheet is then conveyed by the conveyor belt 101 and passes through the fixing unit. The sheet is directed by the flapper 6 in the exhaust switching section 1 along a convey path 87 and is conveyed downward by the feed roller 76. Thereafter, the sheet is fed along the convey path 19 formed between the conveyor belts 10 and the cover plate 17. When the leading end of the sheet reaches the roller 18A, the sheet is urged against the conveyor belts 10. The sheet is reversed immediately after it is urged against the conveyor belts 10, so that the sheet smoothly passes along a convey path 88 formed between the reversing guide plate 20 and the conveyor belts 10 and is housed in a stacker as the upper surface of the bottom plate 21.

Figure 4B:
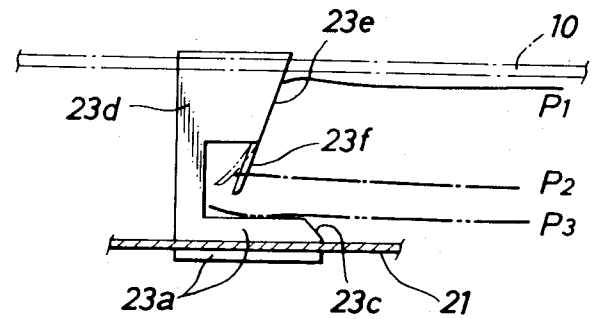
FIG. 4B is a side view for explaining a function of the stopper in FIG. 4A.
Figure 7A:
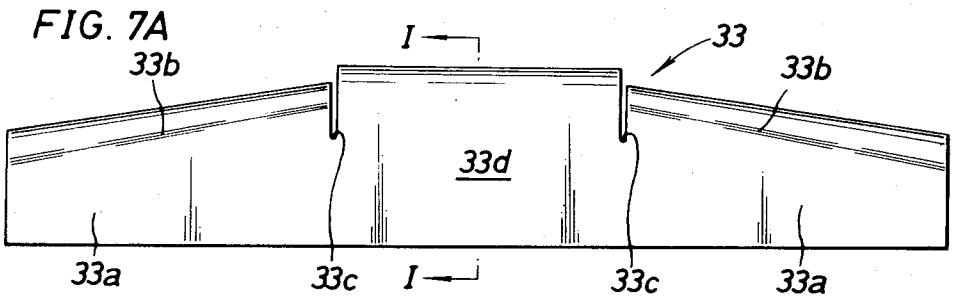
FIG. 7A is a front view of a front end stopper.
Figure 7B:
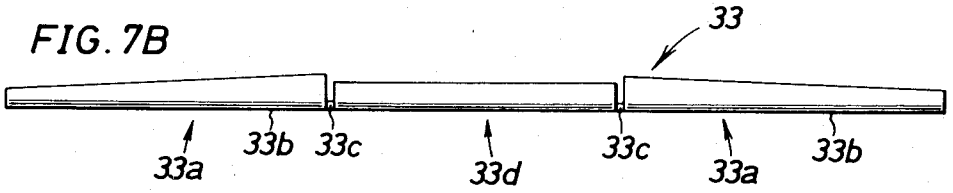
FIG. 7B is a plan view of the front end stopper in FIG. 7A.
Figure 7C:
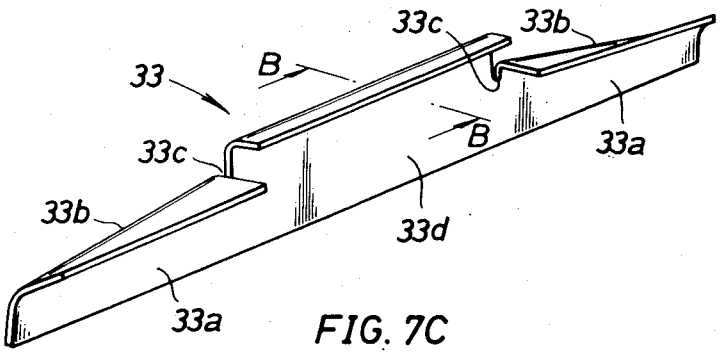
FIG. 7C is a perspective view of the front end stopper in FIG. 7A.
Figure 7D:
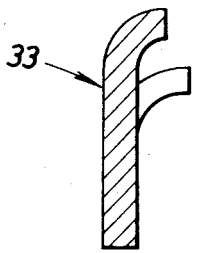
FIG. 7D is a sectional view of the front end stopper of FIG. 7C taken along the line B—B therein.

Even if the sheet is attracted to and conveyed by the conveyor belts 10 due to static electricity or the like, the upper end of the stopper 23 is located above the lower surfaces of the conveyor belts 10. In addition, the stopper has the inclined surface **23*e*. Therefore, even if the sheet is curled in the transfer/separation process in the electrophotographic copying apparatus, the leading end of the sheet is brought into contact with the inlined surface 23*e* and is moved downward therealong, as indicated by a solid line P1 and FIG. 4B. The sheet urges the tongue 25 as indicated by an alternate long and short dashed line P2 and is then inserted between the tongue 23*f* and the bottom portion 23*a***, as indicated by the alternate long and two short dashed line P3. In other words, the sheet is properly placed on the stacker.

The sheets each with a copied surface on one surface are sequentially stored on the stacker. When these sheets are fed out, a signal representing completion of one-side copying is supplied from the electrophotographic copying apparatus to the solenoid 58. The solenoid 58 is then energized to drive the drive source 49. The drive source 80 in the feed section 4 is also started.

The other gear 60 of the Y-shaped swing plate 56 is rotated, and the gear 58 meshed with the gear 60 and the pulley 55 are rotated. The gear 73 having the tooth portion **73*a* meshed with the gear 64** is also rotated.

The stopper 23 is moved forward by the wire 69. The bundle of sheets whose ends are located between the bottom portion **23*a* and the upper portion 23*d*** is also moved forward.

In the stopper 23 shown in FIG. 5A, even if the sheet is curled, its trailing end does not slip upward since the friction member **23*h*** is in contact therewith. Therefore, the front end of the bundle of sheets will not be misaligned, and the bundle can be properly fed.

The drive source 49 and then the stopper 23 are stopped immediately before the leading end of the bundle of sheets is brought into contact with the front end stopper 33 while the leading end is located on the upper surface of the push-up plate 32. At the same time, the pin 78 of the gear 73 urges the lever 77 upward, and the lever 75 is pivoted clockwise by the spring 76. The push-up plate 32 fixed to the shaft 31 of the lever 75 is moved upward, and the uppermost sheet of the bundle of sheets is brought into tight contact with the lower surface of the feed belt 35.

The drive source 80 for the feed belt 35 is rotated for a period required for conveying one sheet. The uppermost sheet is then supplied to the electrophotographic copying apparatus along the guide plate 44.

In addition to the double feed prevention roller 40, the driven roller 38 is in rolling contact with the feed belt 35. The conveying force can be applied to the entire surface up to the trailing end of a sheet of a minimum size. The sheet is not bent at the paper feed portion and then properly transferred to the aligning rollers 104. Furthermore, since the conveying force is applied to the sheet upon abutment of the trailing end of the sheet against the aligning rollers 104, sheet curling can be prevented.

Only the central portion of the leading end of the bundle of sheets is lifted by the push-up plate 32, and the side portions of the leading end are bent downward. The sheet is conveyed while the side portions are being bent downward. Since the central portion of the front end stopper 33 is gradually raised, the portion of the stopper 33 which is in slidable contact with the lower surface of the sheet is also raised. In addition, the angle of the bent portions in increased toward the center of the stopper 33. Therefore, the sides of sheets of any sizes can be bent downward in a similar manner.

The sheet fed out by the feed belt 35 along the guide plate 44 is fed by the aligning rollers 104, and an image is formed on the other surface of the sheet. In this case, the flapper 6 is held by the solenoid 7 in a state indicated by the dotted line in FIG. 3. When two-side copying is completed, the sheet is exhausted outside the electrophotographic copying apparatus. The two-side copied sheets are then sequentially exhausted outside the electrophotographic copying apparatus. An image is formed on the other surface of each of the following one-side copied sheet. When the stacker is emptied, the stopper 23 is held in the initial wait position and the push-up plate 32 is held horizontal.

When the push-up plate 32 is moved up and down every time the sheet is fed out, the pivot member 43 for regulating pivotal movement of the push-up plate 32 is also pivoted up and down. Since the pivot member 43 is coupled to the shaft 41 of the double feed prevention roller 40 through the one-way clutch 42, the double feed prevention roller 40 is pivoted through a predetermined angle. The surface of the roller 40 which is in rolling contact with the feed belt 35 is slightly changed. Therefore, the surface of the double feed prevention roller 40 will not be worn.

In the above embodiment, two pairs of press members are arranged. However, the number of press members is not limited to two pairs but can vary. Although the outer press members have the trapezoidal front ends which are brought into contact with the upper end of the side plates, so that an upward force is applied to the outer press members and hence the press members are arranged to escape outside the movement area of the side plates, the shape of the press members need not be limited to the trapezoidal shape. It is essential for the press members not to interfere the movement of the side plates.

The automatic sheet reversing apparatus of the present invention is constituted as described above. In particular, the vertical dimension of the apparatus can be minimized, so that the received sheets are reversed, stacked, and then properly moved to the predetermined position and discharged. Even if the sheets are electrostatically charged while they are reversed and stacked on the stacker, the sheets can be properly separated from the conveyor belts. Since the apparatus of the present invention has a compact structure, it can be built into a compact electrophotographic copying apparatus.

Various changes and modifications may be made within the spirit and scope and the invention.

What we claim is:

1. An automatic sheet reversing apparatus having: a convey/reversing section for receiving a one-sided copied sheet and conveying the sheet forward through a plurality of conveyor belts, and thereafter reversing the sheet adn conveying it backward; a stacking/moving section, having a stopper brought into contact with a distal end of the reversed sheet, for storing the sheets sequentially reversed and conveyed and for moving the sheets forward to a predetermined position; and a feed section having a feed belt for sequentially feeding the sheets at the predetermined position, characterized in that said stopper in said stacking/moving section is located below said plurality of conveyor belts in said conveying/reversing section, and an upper portion of said stopper is located above lower surfaces of said conveyor belts.

2. An apparatus according to claim 1, wherein said stopper has a rear end upright portion, a front surface of which constitutes a backward inclined surface.

3. An apparatus according to claim 1, wherein driving means of said plurality of conveyor belts is detachable from part of conveying means for conveying the one-side copied sheet.

4. An apparatus according to claim 2, wherein said inclined surface of said upright portion of said stopper has a flexible member at a lower central portion thereof.

5. An apparatus according to claim 2, wherein said inclined surface of said upright portion of said stopper has a friction member at a lower rear portion thereof.

6. An apparatus according to claim 1, wherein said stacking/moving section comprises: side plates for guiding two sides of the sheets stacked at the predetermined position, said side plates being movable in accordance with a sheet size, and there are provided a plurality of press members formed in a sheet inlet port and arranged to escape contact with upper surfaces of the sheets.

7. An apparatus according to claim 5, wherein said press members arranged to escape outside the movement area of said side plates.

8. An apparatus according to claim 5, wherein said press members include at least one press member located within a width of a sheet of a minimum one of sizes used in said automatic sheet reversing apparatus.

* * * * *

UNITED STATES PATENT AND TRADEMARK OFFICE

CERTIFICATE OF CORRECTION

PATENT NO. : 4650176

DATED : March 17, 1987

INVENTOR(S) : Tsugio Sugizaki, et al

It is certified that error appears in the above-identified patent and that said Letters Patent is hereby corrected as shown below: Title page:

Please change the name of the Assignee to "Konishiroku Photo Industry Co., Ltd., Tokyo, Japan"

Signed and Sealed this

Seventeenth Day of November, 1987

*Attest:*

DONALD J. QUIGG

*Attesting Officer*

*Commissioner of Patents and Trademarks*